US006854579B2

(12) United States Patent
Huang

(10) Patent No.: US 6,854,579 B2
(45) Date of Patent: Feb. 15, 2005

(54) ROTATION ANGLE-ADJUSTABLE ROTATING DEVICE

(75) Inventor: Kuo-Fu Huang, Tainan (TW)

(73) Assignee: Royal-G Enterprise Co., Ltd., Tainan (TW)

( * ) Notice: Subject to any disclaimer, the term of this patent is extended or adjusted under 35 U.S.C. 154(b) by 107 days.

(21) Appl. No.: 10/388,130

(22) Filed: Mar. 13, 2003

(65) Prior Publication Data

US 2004/0178042 A1 Sep. 16, 2004

(51) Int. Cl.[7] ..... F16D 71/04
(52) U.S. Cl. ..... 192/138; 192/109 R
(58) Field of Search ..... 192/138, 109 R, 192/110 R, 112, 115; 416/100; 392/366; 318/282

(56) References Cited

U.S. PATENT DOCUMENTS 697,772 A * 4/1902 Allison ..... 192/138
3,625,633 A * 12/1971 Nelson ..... 416/169 R
4,703,152 A * 10/1987 Shih-Chin ..... 392/366
5,193,658 A * 3/1993 Tellden ..... 192/138
5,556,256 A * 9/1996 Shao ..... 416/100
5,690,207 A * 11/1997 Scherch et al. ..... 192/138
6,468,036 B1 * 10/2002 Song et al. ..... 416/100

* cited by examiner

*Primary Examiner*—Saul Rodriguez
(74) *Attorney, Agent, or Firm*—Peacock, Myers & Adams PC

(57) ABSTRACT

An angle-adjustable rotating device includes a mounting part disposed on a peripheral wall of a base member. A drive unit includes a motor and a drive shaft driven by the motor. A mounting seat is sleeved on the drive shaft, and is formed with an engaging member. A control mechanism is associated with the drive shaft in such a manner that rotation direction of the drive shaft is reversed when resistance to rotation of the drive shaft is greater than a predetermined amount of torque of the motor. A resistance providing member is mounted adjustably on the mounting part, and is engageable with the engaging member so as to provide resistance to rotation of the drive shaft.

3 Claims, 5 Drawing Sheets

ROTATION ANGLE-ADJUSTABLE ROTATING DEVICE

BACKGROUND OF THE INVENTION

1. Field of the Invention

The present invention relates to a rotation angle-adjustable rotating device, more particularly to a rotation angle-adjustable rotating device for use in an electrical appliance.

2. Description of the Related Art

A conventional rotating device is shown to be employed in an electrically operated fan, and includes coaxially disposed first and second gears 12, 13, a third gear 14 formed with a coupler shaft 15, a connecting plate 16, and a swing arm 17. The first gear 12 is driven by a threaded portion 111 of a drive shaft 11 of the fan, while the second gear 13 is meshed with the third gear 14. One end of the connecting plate 16 is securely mounted on the coupler shaft 15 for co-rotation therewith, and the other end thereof is pivoted to a first end of the swing arm 17. A pushing element 171 is fixed on a second end of the swing arm 17, and extends into an elongated slot 181 formed in a fan housing 18 of the fan in such a manner that rotation of the drive shaft 11 results in synchronous rotation of the coupler shaft 15, which, in turn, results in a back-and-forth swing action of the swing arm 17, thereby driving the fan housing 18 to swing through the pushing element 171.

One disadvantage of the conventional rotating device resides in that the rotation angle of the fan housing 18 is unadjustable, thereby inconveniencing the user when he or she desires a larger swinging angle of the fan.

SUMMARY OF THE INVENTION

Therefore, the object of this invention is to provide a rotation angle-adjustable rotating device so as to overcome the aforesaid disadvantage of the prior art.

Accordingly, a rotation angle-adjustable rotating device of the present invention includes: a base member having a peripheral wall that defines a receiving space, and an annular mounting part that is disposed securely on the peripheral wall around the receiving space; a drive unit including a motor and a drive shaft driven by the motor; a mounting seat sleeved securely on the drive shaft for co-rotation therewith and formed with an engaging member that is disposed in the receiving space; and a direction control unit including a resistance providing member that is mounted adjustably and securely on the mounting part, that extends into the receiving space, and that is engageable with the engaging member of the mounting seat, the direction control unit further including a control mechanism which is associated with the drive shaft in such a manner that rotation direction of the drive shaft is reversed when the engaging member comes into contact with the resistance providing member to provide a resistance to the rotation of the drive shaft and when the resistance is greater than a predetermined amount of torque of the motor, the resistance providing member being position-adjustable on the mounting part so as to be disposed at different angular positions relative to the mounting part.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
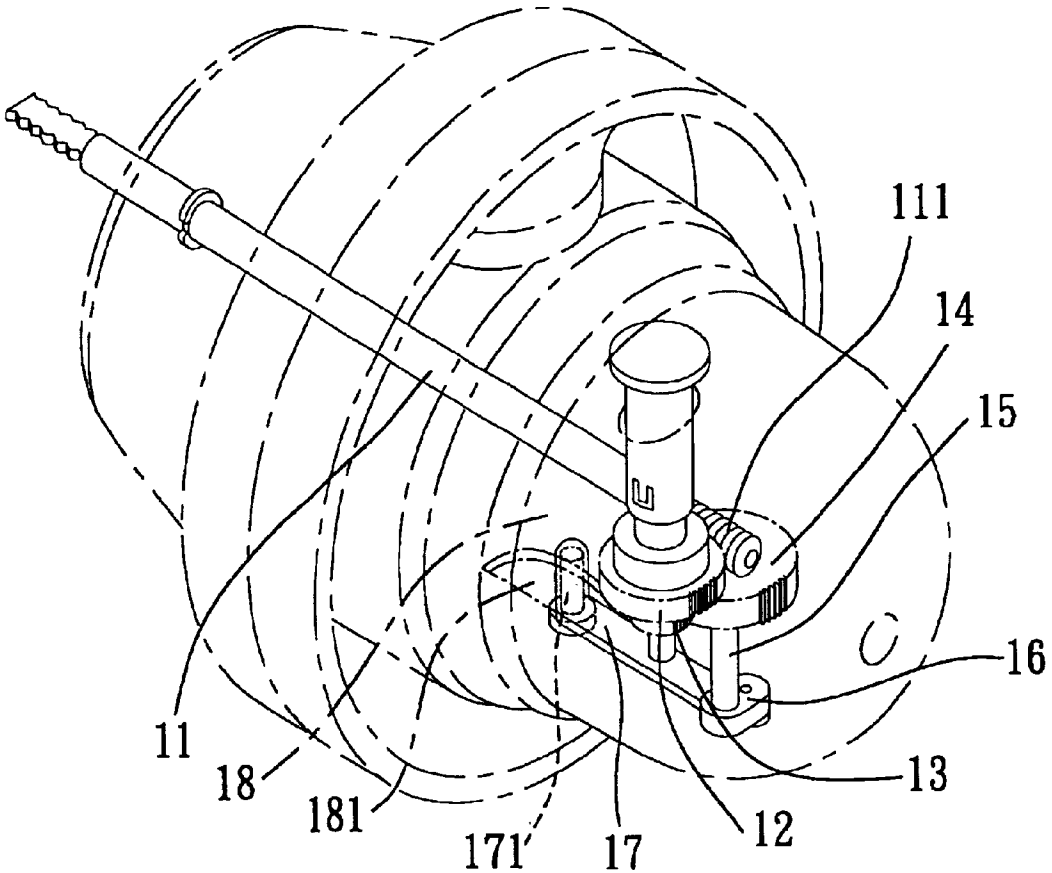
FIG. 1 PRIOR ART
FIG. 1 is a perspective view of a conventional rotating device for rotating a fan.
Figure 2:
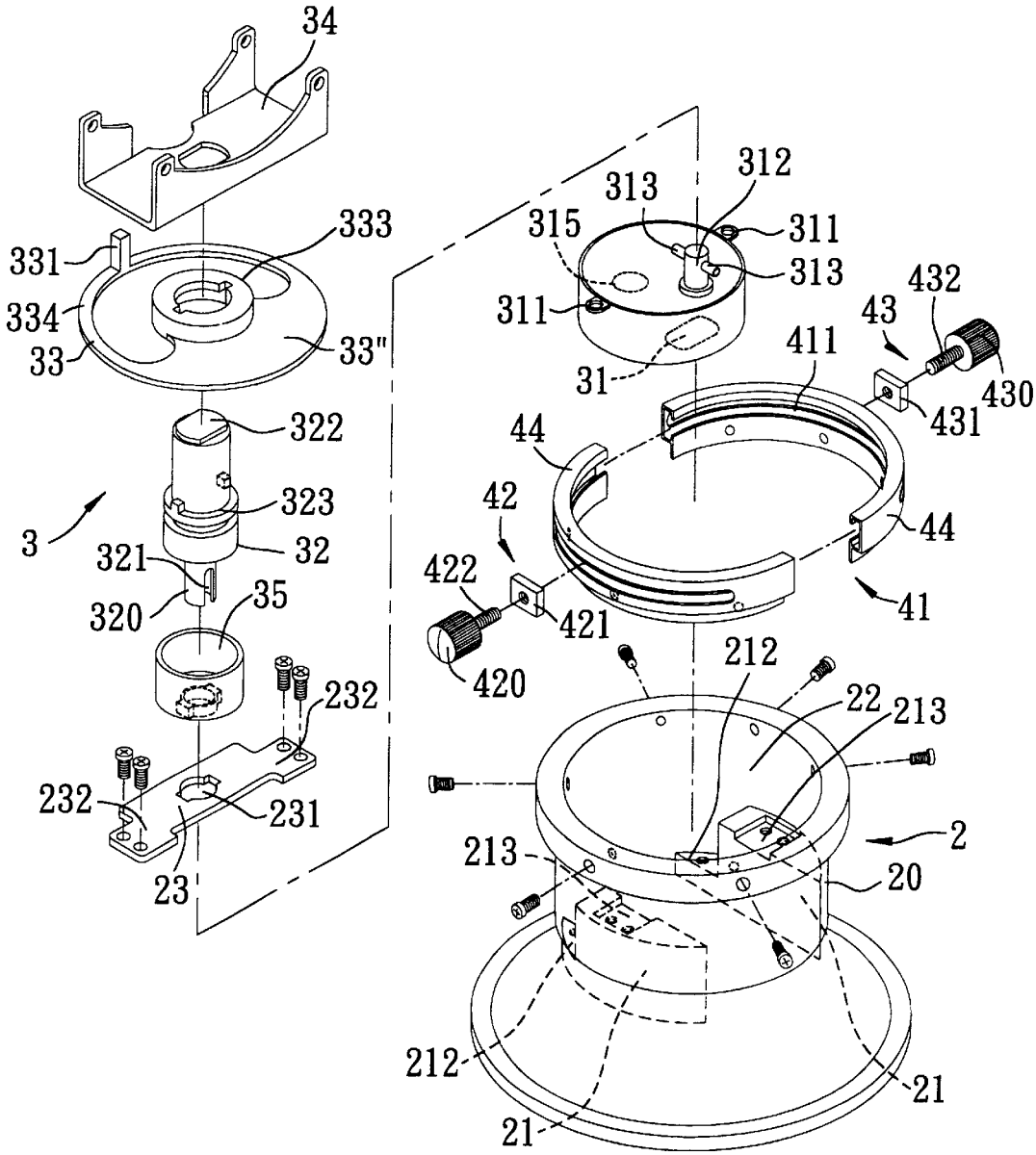
FIG. 2 is an exploded perspective view of the preferred embodiment of a rotation angle-adjustable rotating device according to the present invention for use in an electrical appliance.
Figure 3:
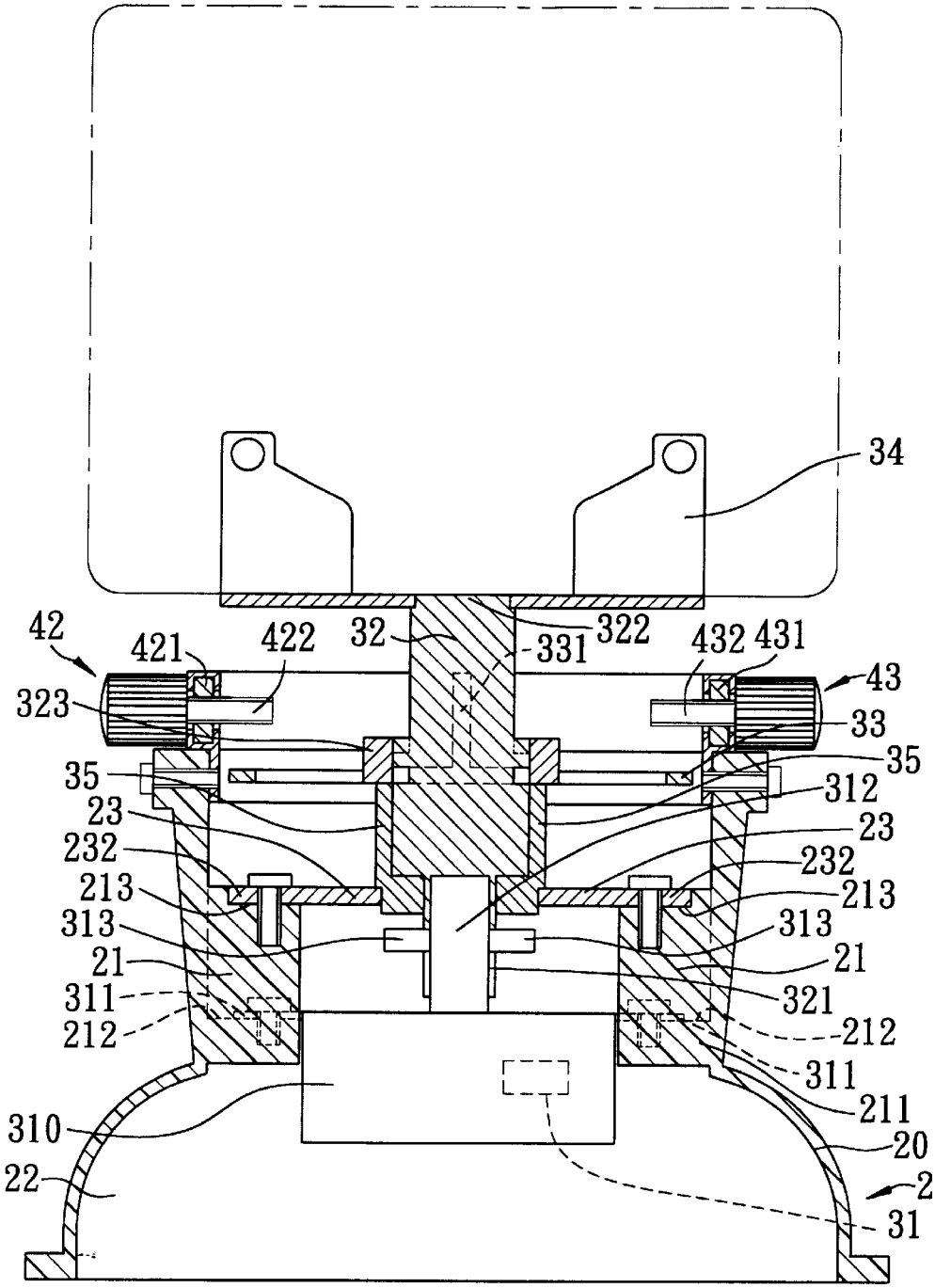
FIG. 3 is a sectional view of the preferred embodiment.

Referring to FIGS. 2 and 3, the preferred embodiment of a rotation angle-adjustable rotating device for an electrical appliance according to the present invention is shown to include a base member 2, a drive unit 3, a mounting seat 33, and a direction control unit.

As illustrated, the base member 2 has a peripheral wall 20 that defines a receiving space 22, and an annular mounting part 41 that is formed on a top end of the peripheral wall 20 and that is disposed around the receiving space 22.

The drive unit 3 includes a DC motor 31 and a drive shaft 312 driven by the DC motor 31.

The mounting seat 33 is disposed below the mounting part 41, and is sleeved securely on the drive shaft 312 through a coupler shaft 32 for co-rotation therewith. The mounting seat 33 is formed with an engaging member 331 that is disposed in the receiving space 22.

The direction control unit includes a control mechanism 315 and a resistance providing member (42,43). The resistance providing member (42,43) is mounted adjustably and securely on the mounting part 41, extends into the receiving space 22 of the base member 2, and is engageable with the engaging member 331 of the mounting seat 33. The control mechanism 315 is associated with the drive shaft 312 in such a manner that rotation direction of the drive shaft 312 is reversed when the engaging member 331 of the mounting seat 33 comes into contact with the resistance providing member (42,43) to provide a resistance to the rotation of the drive shaft 312 and when the resistance is greater than a predetermined amount of torque of the motor 31. The control mechanism 315 can be a mechanical device, such as a ratchet unit, so long as it can reverse the rotation direction of the drive shaft 312 when the resistance is greater than the predetermined amount of torque of the motor 31. The resistance providing member (42,43) is position-adjustable on the mounting part 41 so as to be disposed at different angular positions relative to the mounting part 41.

Figure 4:
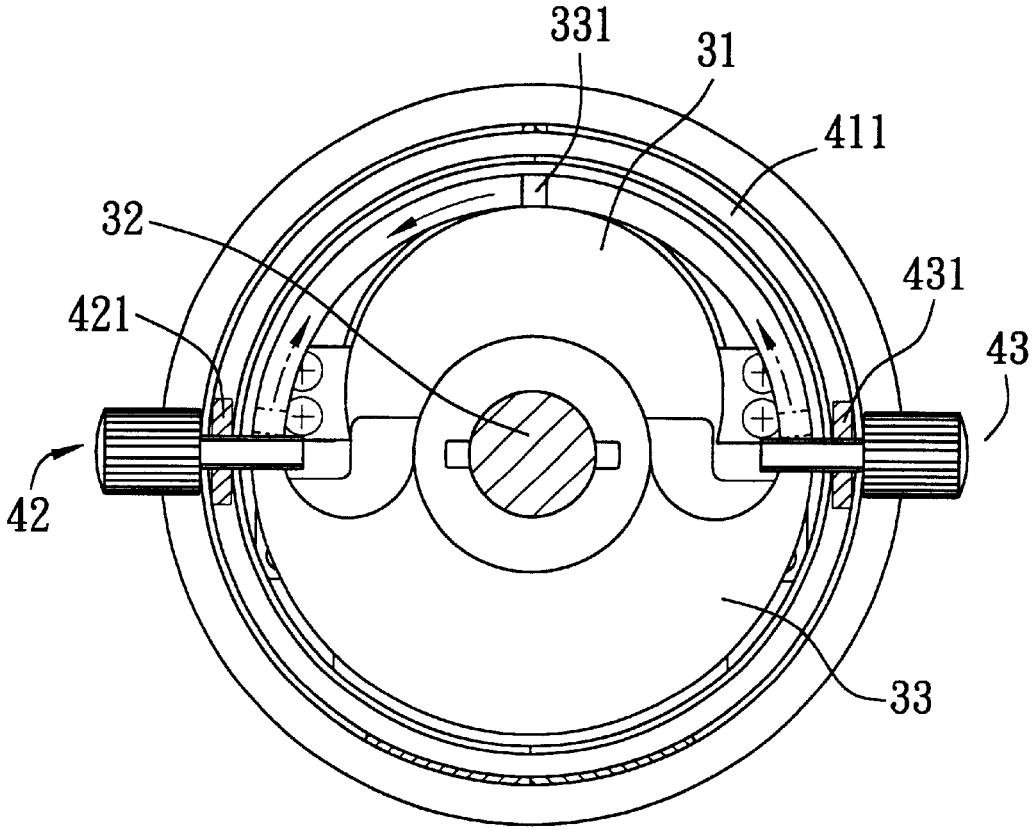
FIG. 4 is a view illustrating how an object is controlled by the preferred embodiment to rotate 180 degrees.

In this preferred embodiment, the mounting part 41 includes two halves 44 that are mounted securely on the top end of the peripheral wall 20 and that cooperatively define an annular slot 411 around and in spatial communication with the receiving space 22 in the base member 2. The resistance providing member (42,43) includes first and second sliding plates 421,431 that are slidably received in the annular slot 411, and first and second fasteners 420,430 formed with first and second engaging screw rods 422,432 that are angularly spaced apart from each other, that threadedly and respectively engage the first and second sliding plates 421,431, and that project respectively from the first and second sliding plates 421,431 into the receiving space 22 for engaging the engaging member 331 of the mounting seat 33 so as to permit movement of the mounting seat 33 between the first and second engaging screw rods 422,432 in a back-and-forth manner, as best shown in FIG. 4.

Figure 5:
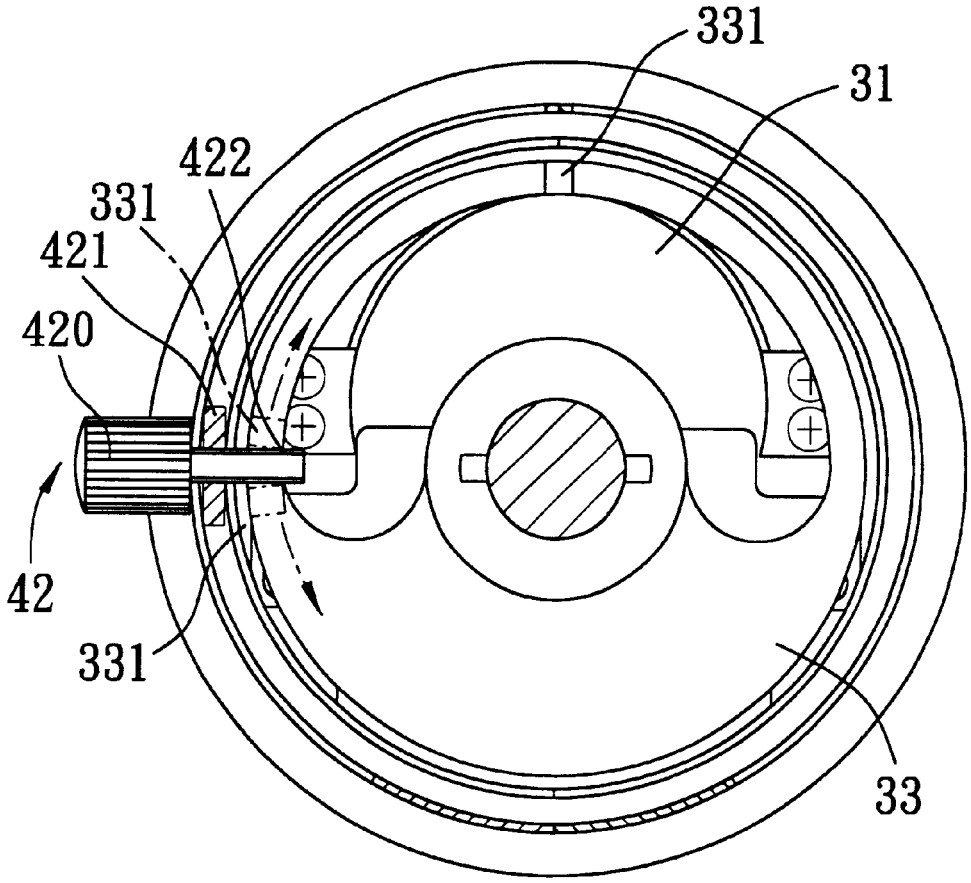
FIG. 5 is a view illustrating how an object is controlled by the preferred embodiment to rotate 360 degrees.

Referring to FIG. 5, when it is desired to rotate the mounting seat 33 360 degrees, only one sliding plate 421 and one fastener 420 are employed in such a manner that the engaging member 331 of the mounting seat 33 will reverse its rotation direction from a clockwise direction to a counterclockwise direction by an arrow in dotted line or vice versa when the resistance to rotation of the drive shaft 312 resulting from engagement between the screw rod 422 of the fastener 420 and the engaging member 331 is greater than the predetermined torque of the motor 31.

The base member 2 preferably includes left and right positioning seats 21 that are disposed in the receiving space 22, that project inwardly and radially from the peripheral wall 20, and that are formed with two opposing lower positioning parts 212. The drive unit 3 further includes a protective casing 310 that encloses the motor 31 and the control mechanism 315 therein and that is formed with two opposite mounting ends 311 which are respectively secured to the lower positioning parts 212 of the positioning seats 21. The drive shaft 312 protrudes outwardly from the protective casing 310, and is formed with two opposite engaging tongues 313, the purpose of which will be described in the following paragraphs.

The positioning seats 21 are further formed with opposing upper positioning parts 213 disposed above the respective lower positioning parts 212. The base member 2 further includes a mounting plate 23 that has two opposite ends 232 respectively secured to the upper positioning parts 213 of the positioning seats 21 and that is formed with a shaft-extension hole 231 between the opposite ends 232. A shaft-retention sleeve 35 is fixed to the mounting plate 23 around the shaft-extension hole 231. The coupler shaft 32 has a lower coupling end 320 that is formed with two axial engaging slots 321, an upper coupling end 322 opposite to the lower coupling end 320, and an enlarged portion 323 that extends between the upper and lower coupling ends 320, 322, and that is received rotatably in the shaft-retention sleeve 35. The lower coupling end 320 of the coupler shaft 32 extends through the shaft-extension hole 231 in the mounting plate 23. The drive shaft 312 extends into the lower coupling end 320 of the coupler shaft 32 in such a manner that the engaging tongues 313 of the drive shaft 312 extend respectively through the axial slots 321 in the coupler shaft 32 so as to permit synchronous rotation of the coupler shaft 32 with the drive shaft 312. The mounting seat 33 includes an annular disc 33" that has a central part 333 sleeved securely on the enlarged portion 323 of the coupler shaft 32, and a peripheral part 334 around the central part 333. The engaging member 331 projects transversely from the peripheral part 334 of the annular disc 33". The upper coupling end 322 of the coupler shaft 32 extends through the annular disc 33" to hold a holding frame 34 securely thereon. An electrical appliance, such as a fan, can be mounted on the holding frame 34 for co-rotation with the coupler shaft 32.

When the angle-adjustable rotating device of the present invention is employed in an electrical appliance, the rotation angle of the latter can be controlled and adjusted. Thus, the aforesaid disadvantage of the prior art can be overcome.

With this invention thus explained, it is apparent that numerous modifications and variations can be made without departing from the scope and spirit of this invention. It is therefore intended that the invention be limited only as indicated in the appended claims.

I claim:

1. A rotation angle-adjustable rotating device comprising:

a base member having a peripheral wall that defines a receiving space, and an annular mounting part that is disposed securely on said peripheral wall around said receiving space;

a drive unit including a motor and a drive shaft driven by said motor;

a mounting seat sleeved securely on said drive shaft for co-rotation therewith and formed with an engaging member that is disposed in said receiving space; and a direction control unit including a resistance providing member that is mounted adjustably and securely on said mounting part, that extends into said receiving space, and that is engageable with said engaging member of said mounting seat, said direction control unit further including a control mechanism which is associated with said drive shaft in such a manner that rotation direction of said drive shaft is reversed when said engaging member comes into contact with said resistance providing member to provide a resistance to the rotation of said drive shaft and when the resistance is greater than a predetermined amount of torque of said motor, said resistance providing member being position-adjustable on said mounting part so as to be disposed at different angular positions relative to said mounting part.

2. The rotation angle-adjustable rotating device as defined in claim 1, wherein said mounting part defines an annular slot around and in spatial communication with said receiving space, said resistance providing member including first and second sliding plates that are slidably received in said slot, and first and second fasteners which are formed with first and second engaging screw rods that threadedly and respectively engage said sliding plates and that project respectively from said sliding plates into said receiving space for engaging said engaging member so as to permit movement of said mounting seat between said first and second engaging screw rods in a back-and-forth manner.

3. The rotation angle-adjustable rotating device as defined in claim 2, wherein said base member further includes a mounting plate secured to said peripheral wall within said receiving space and formed with a shaft-extension hole, said mounting seat including a coupler shaft and an annular disc that is sleeved on said coupler shaft, said coupler shaft having a lower coupling end that is formed with two axially extending engaging slots, an upper coupling end opposite to said lower coupling end, and an enlarged portion extending between said lower and upper coupling ends, said annular disc being sleeved on said enlarged portion of said coupler shaft, said lower coupling end of said coupler shaft extending into said shaft-extension hole in said mounting plate, said drive shaft being formed with two engaging tongues and extending into said lower coupling end of said coupler shaft in such a manner that said engaging tongues extend respectively through said axial slots so as to permit synchronous rotation of said coupler shaft with said drive shaft.

* * * * *